US008732905B2

(12) United States Patent
Bell

(10) Patent No.: US 8,732,905 B2
(45) Date of Patent: May 27, 2014

(54) DOOR OR WINDOW CLOSER

(75) Inventor: Robert Matthew Bell, Monroe, NC (US)

(73) Assignee: Yale Security Inc., Monroe, NC (US)

( * ) Notice: Subject to any disclaimer, the term of this patent is extended or adjusted under 35 U.S.C. 154(b) by 591 days.

(21) Appl. No.: 12/704,297

(22) Filed: Feb. 11, 2010

(65) Prior Publication Data

US 2011/0191981 A1 Aug. 11, 2011

(51) Int. Cl.
*E05F 1/00* (2006.01)

(52) U.S. Cl.
USPC ..... 16/71; 16/DIG. 39

(58) Field of Classification Search
CPC ..... E05F 3/00; E05F 3/02; E05F 3/04; E05F 3/06; E05F 3/08; E05F 3/10; E05F 3/102; E05F 3/104; E05F 3/106; E05F 3/108; E05F 3/12; E05F 3/14; E05F 3/16; E05F 3/18; E05F 3/20
USPC ..... 16/71, DIG. 39, DIG. 10, 79, 80, 72, 75, 16/76, 49, 51, 64, 65; 116/204
See application file for complete search history.

(56) References Cited

U.S. PATENT DOCUMENTS 2,660,719 A 11/1953 Stromberg
3,392,419 A * 7/1968 Stein et al. ..... 16/49
4,016,827 A 4/1977 Lawrence, Jr.
4,590,639 A 5/1986 Fritsche et al.
4,686,739 A * 8/1987 Fritsche et al. ..... 16/79
4,783,882 A 11/1988 Frolov
4,785,493 A * 11/1988 Tillmann et al. ..... 16/53
5,265,306 A * 11/1993 Yu ..... 16/51
5,497,725 A 3/1996 Theisen et al.
6,167,589 B1 1/2001 Luedtke
6,282,750 B1 9/2001 Bishop et al.
6,435,026 B1 8/2002 Donehue (Continued)

FOREIGN PATENT DOCUMENTS

EP 0292743 A1 11/1988

OTHER PUBLICATIONS

Shenzhen Hongan Magnetism & Technology Co.Ltd., CYX-4 Magnetic Liquid-Level Indicator for Steam Drum Boiler, http://www.szhncmsc.com/E-CYX-4.html, Oct. 7, 2009, 2 pages.

(Continued)

*Primary Examiner* — Jeffrey O Brien
(74) *Attorney, Agent, or Firm* — Michael G. Johnston; Moore and Van Allen PLLC

(57) ABSTRACT

A spring power setting indicator for a closing apparatus for a wing such as a door or window, including a closer housing in which a compression spring is disposed. The spring power setting indicator includes a collar defining a threaded opening adapted to engage an adjustment screw for adjusting the bias of the compression spring. The collar may be substantially disc-shaped, and has a peripheral side that defines an annular channel in which a magnetic ball is disposed. An indicator housing with indicia of closer size may be mounted to the closer housing. Another magnetic ball may be disposed in the indicator housing. The magnetic balls are attracted to each other, and the ball in the indicator housing follows the ball in the channel as the collar moves in response to turning of the adjustment screw, permitting external reading of closer size with the indicia based on ball position.

14 Claims, 4 Drawing Sheets

(56) References Cited

U.S. PATENT DOCUMENTS

| | | | | |
|---|---|---|---|---|
| 6,588,272 | B2 | 7/2003 | Mulrooney et al. | |
| 7,070,375 | B2 | 7/2006 | Hoeckelman | |
| 7,971,316 | B2 * | 7/2011 | Copeland et al. | 16/79 |

OTHER PUBLICATIONS

Levelstate Systems Ltd, Levelstate Systems, http://www.levelstate.com/gauge%20glass.htnn, Oct. 7, 2009, 6 pages.

* cited by examiner

DOOR OR WINDOW CLOSER

BACKGROUND

Door closers provide an automatic function of closing a door and help to ensure that doors are not inadvertently left open. Many conventional door closers are mechanically actuated and have a piston and one or more compression springs and ports. The compression spring provides the force for moving the door toward a closed position. A door closer is sized, or has a force setting, based on pre-loading of the compression spring with an initial bias in accordance with American National Standards Institute (ANSI) standards. ANSI standards specify the minimum force required to close a door as sizes 1 through 6, with 6 being the greatest closing force of the door closer.

During use of a door closer, the piston moves through a reservoir filled with a hydraulic fluid, such as oil. The piston is coupled to the door closer's arm such that, as the door is opened, the piston is moved in one direction and, as the door is closed, the piston is moved in the opposite direction. As the piston moves, it displaces hydraulic fluid, which may be forced through various ports. The force exerted by the door closer depends on loading of the compression spring and the speed of the action depends on the open or closed status of the ports. The ports are adjustable (open or closed) via needle valves that control flow of hydraulic fluid, and the compression spring setting may or may not be adjustable based on the construction of the door closer.

The compression spring must be set properly for a given door and installation. While some door closers are not adjustable and are designed to meet only one size, most are adjustable and cover the entire range of sizes 1 through 6. These must be adjusted during or after installation to meet the requirements of that particular opening. Commonly this is done by the manufacturer specifying a number of turns of a screw that extends from one end of the closer to pre-load the compression spring. Turning the screw in one direction increases the pre-load of the compression spring, while turning the screw in the other direction reduces the pre-load. There is no visible result external to the housing of the door closer from turning the screw. While certain attempts have been made at providing external indication of size, there exists a need for a door closer with a spring power setting indicator that improves ease of manufacture and installation.

SUMMARY

In accordance with one embodiment of a closer, a closing apparatus for a wing is provided, comprising a closer housing, a piston, a compression spring, an adjustment screw, a collar, and a ball. The closer housing is adapted to be mounted to a wing or structure adjacent to a wing and has a first end, a second end, and a longitudinal axis extending between the two ends. The piston is disposed in the closer housing for reciprocal movement along the longitudinal axis. The compression spring is disposed in the closer housing and has a first end abutting the piston and a second end disposed between the compression spring first end and the closer housing second end. The adjustment screw is at least partially disposed in the closer housing along the longitudinal axis and proximate to the housing second end. The collar is disposed in the closer housing and defines a threaded opening through which the adjustment screw passes. The threads of the adjustment screw engage the threads of the opening. The collar is adapted to travel along the adjustment screw as the screw is turned, has a first face abutting the second end of the compression spring, and has a circular periphery, a second face having a circular periphery, and a side extending between the circular periphery of the first face and the circular periphery of the second face. The side of the collar defines an annular channel. A magnetic ball that is a permanent magnet is disposed in the annular channel.

The closing apparatus may also include an indicator housing mounted to the closer housing external to the closer housing, and the indicator housing may define an elongated passage. A magnetically permeable element, such as a magnetic ball that is a permanent magnet, may be disposed in the elongated passage of the indicator housing.

In accordance with another embodiment described herein, a spring power setting indicator for a closing apparatus for a wing including a closer housing in which a compression spring is disposed is provided. The spring power setting indicator includes a collar defining a threaded opening adapted to engage an adjustment screw for adjusting the bias of the compression spring. The collar has a first face adapted to abut the second end of the compression spring and has a circular periphery, a second face having a circular periphery, and a side extending between the circular periphery of the first face and the circular periphery of the second face. The side defines an annular channel. A magnetic ball that is a permanent magnet is disposed in the annular channel.

The spring power setting indicator may also include an indicator housing mounted to the closer housing external to the closer housing, and the indicator housing may define an elongated passage. A magnetically permeable material, such as a magnetic ball that is a permanent magnet, may be disposed in the elongated passage of the indicator housing.

In accordance with another embodiment described herein, a method of making a closing apparatus for a wing is provided. The method includes providing a closer housing adapted to be mounted to a wing or structure adjacent to a wing and having a first end, a second end, and a longitudinal axis extending between the ends. A piston is disposed in the closer housing for reciprocal movement along the longitudinal axis. A compression spring is disposed in the closer housing, and has a first end abutting the piston and a second end disposed between the compression spring first end and the closer housing second end. An adjustment screw is disposed at least partially in the closer housing along the longitudinal axis and proximate to the housing second end. A collar is disposed in the closer housing, and the collar defines a threaded opening through which the adjustment screw passes, with the threads of the adjustment screw engaging the threads of the opening, such that the collar is adapted to travel along the adjustment screw as the screw is turned. The collar has a first face abutting the second end of the compression spring and having a circular periphery, a second face having a circular periphery, and a side extending between the circular periphery of the first face and the circular periphery of the second face. The side defines an annular channel. A magnetic ball that is a permanent magnet is disposed in the annular channel.

In accordance with another embodiment described herein, a method of installing a closing apparatus for a wing is provided. The closing apparatus includes a closer housing adapted to be mounted to a wing or structure adjacent to a wing and has a first end, a second end, and a longitudinal axis extending between the ends. A piston is disposed in the closer housing for reciprocal movement along the longitudinal axis, and a compression spring is also disposed in the closer housing, having a first end abutting the piston and a second end disposed between the compression spring first end and the closer housing second end. An adjustment screw is disposed at least partially in the closer housing along the longitudinal axis and proximate to the housing second end. A collar is disposed in the closer housing, defining a threaded opening through which the adjustment screw passes. The threads of the adjustment screw engage the threads of the opening, and the collar is adapted to travel along the adjustment screw as the screw is turned. The collar has a first face abutting the second end of the compression spring with a circular periphery, a second face having a circular periphery, and a side extending between the circular periphery of the first face and the circular periphery of the second face. The side defines an annular channel and a magnetic ball that is a permanent magnet is disposed in the annular channel. An indicator housing is mounted to the closer housing external to the closer housing, and defines an elongated passage. A magnetic ball that is a permanent magnet is disposed in the elongated passage of the indicator housing. The method includes rotating the closer housing to cause the magnetic ball in the annular channel to be proximate to the magnetic ball in the elongated passage of the indicator housing, and mounting the closer housing to a wing or structure adjacent to a wing.

BRIEF DESCRIPTION OF THE DRAWINGS

For a more complete understanding of embodiments of a door closer and associated methods, reference should now be had to the embodiments shown in the accompanying drawings and described below. In the drawings.

DESCRIPTION

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise.

As used herein, the term "open position" for a door means a door position other than a fully closed position, including any position between the fully closed position and a fully open position as limited only by structure around the door frame, which can be up to 180° from the closed position.

Figure 1:
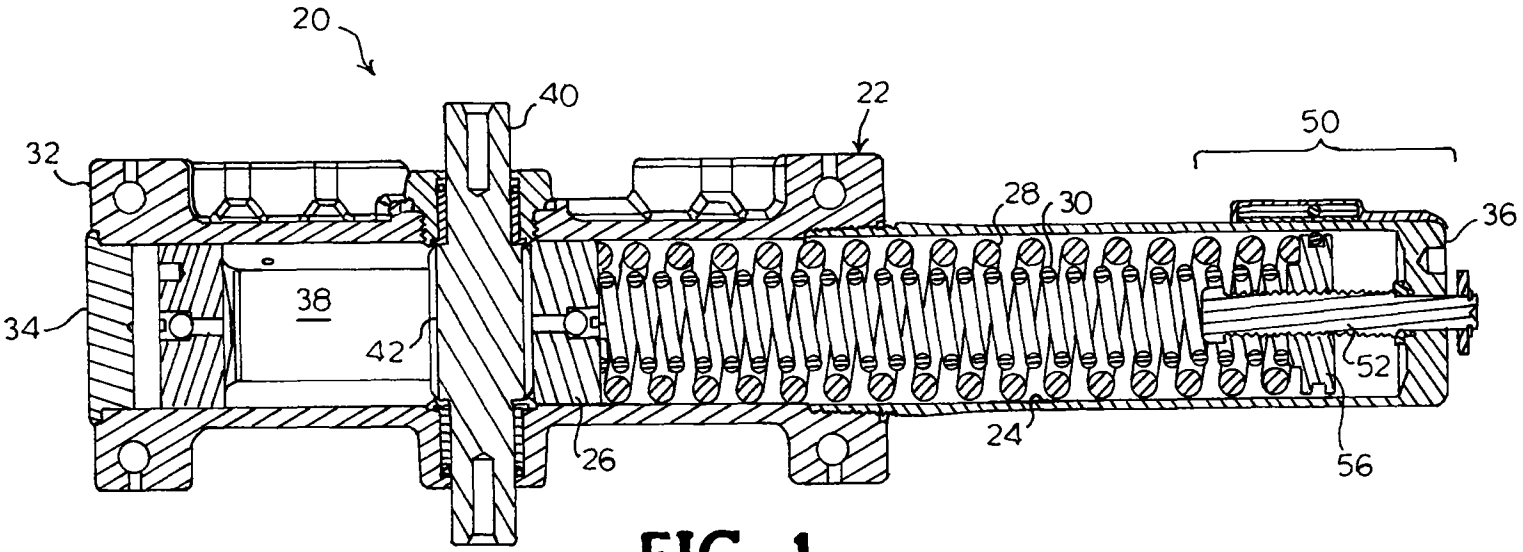
FIG. 1 is a section view of one embodiment of a door closer described herein.

Referring now to the drawings, wherein like reference numerals designate corresponding or similar elements throughout the several views, an embodiment of a door closer 20 is shown in FIG. 1, and is generally designated at 20. Although such embodiment is referenced herein as a door closer, the embodiment could likewise be applied to a hinged window, or any pivotally mounted member that may also be referred to as a wing or panel. The closing apparatus may be mounted either to, or adjacent to, a wing in a frame for movement of the wing relative to the frame between a closed position and an open position. The wing may be of a conventional type, or any type of wing that is pivotally mounted to the frame for movement from the closed position to an open position for opening and closing an opening through a structure wall, such as to allow a user to travel from one side of the wall to the other side of the wall.

The embodiment of a door closer 20 of FIG. 1 includes a closer housing 22 that in part defines a substantially cylindrical reservoir 24, a piston 26 and compression springs 28, 30 biased against the piston 26 in the reservoir 24, a first end 32 with a removable end cap 34, and a second end 36 that is closed, but could alternatively have an end cap. A rack 38 is attached to the piston 26. The rack 38 is driven by a pinion 40 through engagement with the teeth 42 of the pinion 40. The pinion 40 is connected to a closer arm assembly (not shown) for operably coupling the door closer 20 to a door. FIG. 1 shows the door closer 20 in a position corresponding to a closed door. As the door is opened, the pinion 40 rotates in an initial direction, transporting the rack 38 and consequently sliding the piston 26 to the right in FIG. 1. The compression springs 28, 30 urge the piston 26 and rack 38 to the left in FIG. 1. When the force of the compression springs 28, 30 overcomes the input force from the door and pinion 40 such as when the door is released, the compression springs 28, 30 will force the piston 26 to the left in FIG. 1, and the pinion 40 will rotate in a direction opposite the initial direction and the door closer 20 will act to close the door.

Figure 2:
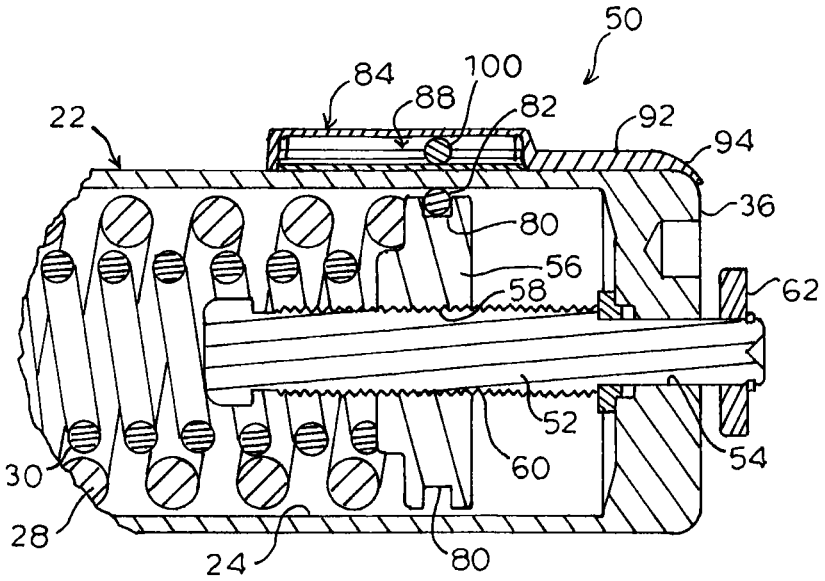
FIG. 2 is an enlarged section view of a portion of the embodiment of FIG. 1.
Figure 3:
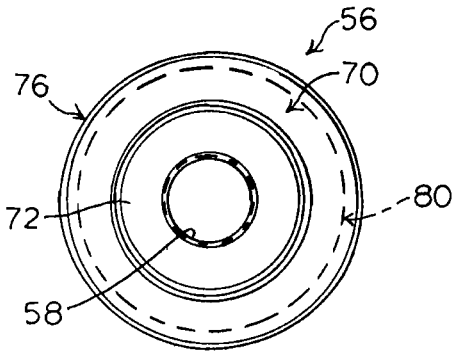
FIG. 3 is a front view of an embodiment of a spring adjusting collar as shown in FIG. 1.
Figure 4:
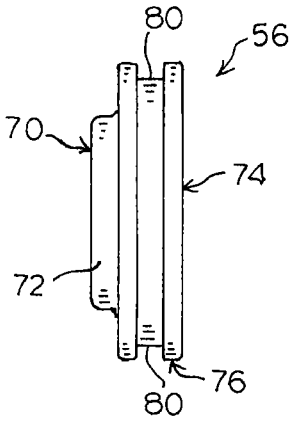
FIG. 4 is a side elevation view of the embodiment of the spring adjusting collar as shown in FIG. 1.

An embodiment of a readable adjustment mechanism 50 is provided for adjusting the bias of the compression springs 28, 30 on the piston 26 and displaying the size, or force setting, of the door closer 20. As shown in FIG. 2, the embodiment of a readable adjustment mechanism 50 includes an adjustment screw 52 that passes through an opening in the closed end 36 of the closer housing 22, and a spring adjustment collar 56 with an internally threaded opening 58 that engages the threads 60 of the adjustment screw 52. The compression springs 28, are biased against the collar 56, which travels along the adjustment screw 52. The end of the adjustment screw 52 that is outside the closer housing 22 includes means for turning the adjustment screw 52, such as, for example, a nut 62, knob, or socket. When the adjustment screw 52 is turned in a first direction, the collar 56 travels to the left relative to the closer housing 22 in FIGS. 1 and 2, increasing the pre-load on the compression springs 28, 30, and when the adjustment screw 52 is turned in the opposite direction, the collar 56 travels to the right in FIGS. 1 and 2, decreasing the pre-load on the compression springs 28, 30. The collar 56 may be substantially disc-shaped as shown in FIGS. 3 and 4. As shown, one face 70 of the collar 56 may be adapted to receive the compression springs 28, 30, including a central protrusion 72, while the opposite face 74 may be flat. The periphery of each face 70, 74 may be substantially circular, and a side 76 of the collar 56 extends between the faces 70, 74. The side 76 of the collar 56 defines an annular channel 80 that extends completely around the collar 56. The cross-sectional shape of the channel 80 may be rectangular as shown, or another shape such as semi-circular, as selected by one of ordinary skill in the art. As shown in FIG. 2, a magnetic ball 82 that is a permanent magnet is disposed in the annular channel 80.

Figure 5:
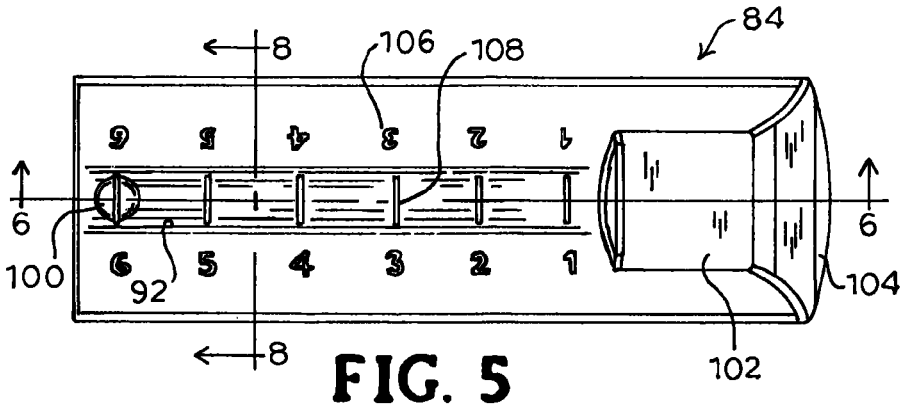
FIG. 5 is a top plan view of an embodiment of a spring power setting indicator housing as shown in FIG. 1.
Figure 6:
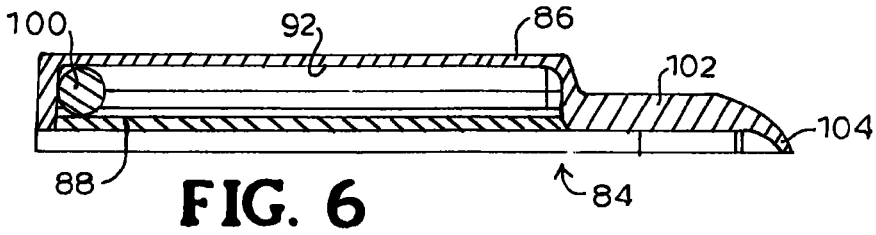
FIG. 6 is a section view of the embodiment of the spring power setting indicator housing along line 6-6 of FIG. 5.
Figure 7:
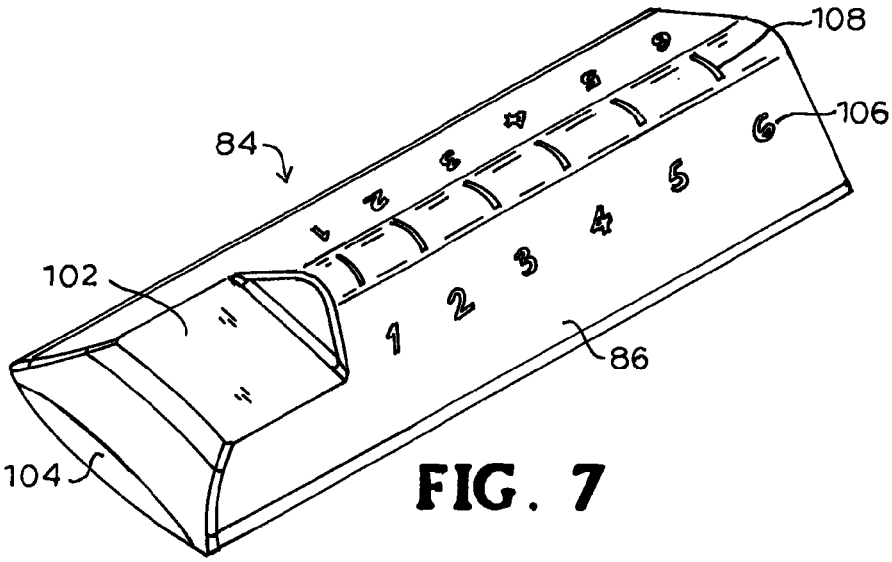
FIG. 7 is a perspective view of the embodiment of a spring power setting indicator housing of FIG. 1.

The readable adjustment mechanism 50 further includes an indicator housing 84 mounted to the outside of the closer housing 22. An embodiment of an indicator housing 84 is shown in FIGS. 5-7. The indicator housing 84 may include a top element 86 and bottom element 88 that may snap together or be otherwise connected. When connected, the top element 86 and bottom element 88 may define an elongated passage 92, which may be closed as shown or may form an open slot along its length. The indicator housing 84 may be plastic in one embodiment, may include metal, and at least the top surface may be transparent in order to view one or more magnetically permeable elements disposed in the elongated passage 92. The magnetically permeable element may be a magnetic ball 100 that is a permanent magnet, as shown, or may be, for example, magnetized particles or non-magnetized, magnetically permeable particles dispersed in a fluid, or a steel ball.

Figure 8:
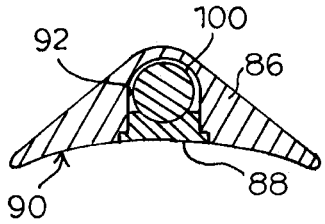
FIG. 8 is a cross-section view of the embodiment of the spring power setting indicator housing along line 8-8 of FIG. 5.
Figure 9:
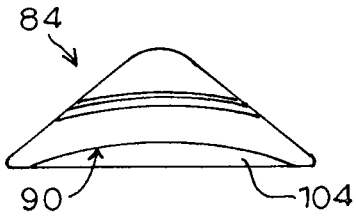
FIG. 9 is an end view of the embodiment of a spring power setting indicator housing of FIG. 1, as seen from the left end of FIG. 5.

Referring again to FIGS. 1 and 2, the indicator housing is secured to the second closed end 36 of the housing 22. As best seen in FIGS. 8 and 9, the base surface 90 of the indicator housing 84 may be shaped to conform to the shape of the outside surface of the closer housing 22 that the indicator housing 84 contacts, which generally is curved. An extension portion 102 (FIGS. 5 and 6) of the indicator housing 84 may be provided with a bend 104 at its free end that may conform to the shape of the closed end 36 of the closer housing 22, allowing registration with the end of the closer housing 22 to provide accurate and simple means for locating the indicator housing 84 on the closer housing 22.

Figure 10:
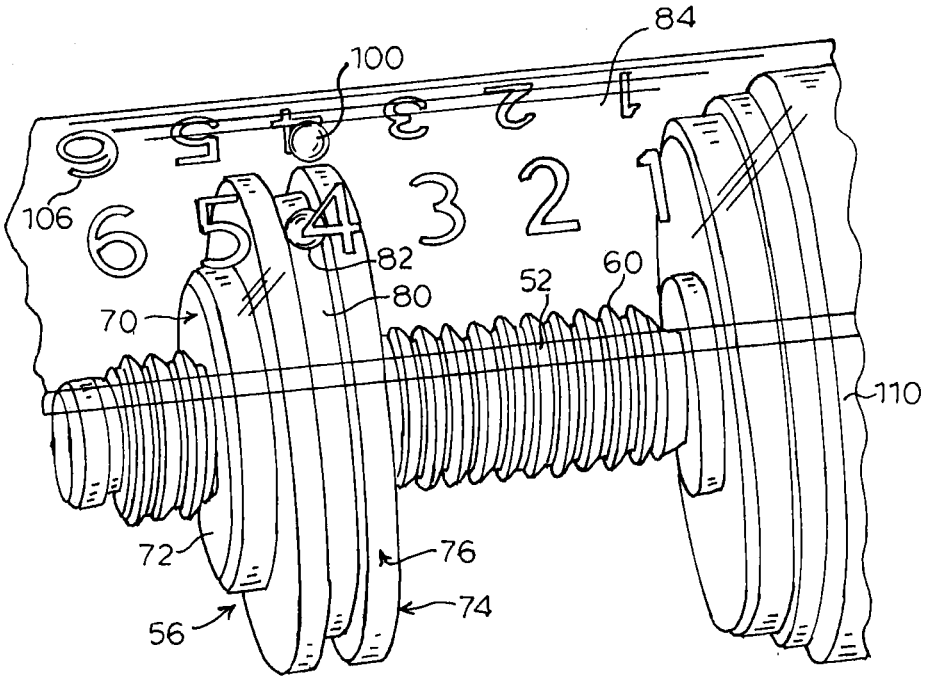
FIG. 10 is an enlarged perspective view of a portion of the embodiment of the door closer of FIG. 1, with the closer housing being transparent for illustrative purposes.

The indicator housing 84 may include indicia, such as numbers 106 or others markings 108 that correspond to a size of the closer 20. The magnetic ball 100 in the indicator housing 84 and the magnetic ball 82 in the annular channel 80 of the collar 56 are attracted to each other, and as the collar 56 moves with the ball 82 in the annular channel 80 based on the position of the collar 56 along the adjustment screw 52, the ball 100 in the indicator housing 84 moves likewise to remain aligned with the ball 82 in the annular channel 80. Thus, the position of the ball 82 in the annular channel 80 is tracked and duplicated by the ball 100 in the indicator housing 84 for displaying the position of the collar 56 via the indicator housing ball 100. The markings 106, 108 of size on the indicator housing are calibrated by the manufacturer for each specific closer model to correspond to ANSI sizes, and the position of the collar as shown by the indicator housing ball 100 and the indicia 106, 108 on the indicator housing 84 is a reading of the size. FIG. 10 shows both balls 82, 100, the collar 56, the adjustment screw 52, an end cover 110 of a closer housing, and the transparent indicator housing 84 with numerical indicia 106, with the closer housing not shown in order to better understand the relationship of the parts.

The readable adjustment mechanism 50 may be used with a variety of door closers in addition to the door closer 20 depicted and described in FIG. 1. For the magnetically based operation to be effective, the closer housing 22 and the spring adjustment collar 56 may be made of non-magnetically permeable material such as stainless steel, or aluminum, which may be coated with zinc for corrosion protection. The indicator housing 84 may also include such materials, as well as plastic or glass through which to view the magnetic ball 100. The indicator housing 84 may be mounted to the closer housing 22 using a variety of adhesives such as epoxy or other means known to one of ordinary skill in the art.

In manufacturing and installation of the door closer 20, no particular angular orientation of the collar 56 around the adjustment screw 52 is required in order for the placement of the magnetic ball 82 in the channel to be properly positioned. The ball 82 is free to move within the channel, and the closer housing 22 may be rotated to align the ball 82 in the channel with the ball 100 in the indicator housing 84. This may be done either during manufacturing of the door closer 20 or immediately prior to installation of the door closer 20.

Although the door closer described above has been shown and described in considerable detail with respect to only a few exemplary embodiments thereof, it should be understood by those skilled in the art that it is not intended to be limited to these embodiments since various modifications, omissions and additions may be made to the disclosed embodiments without materially departing from the novel teachings and advantages. For example, some of the novel features could be used with any type of wing closer. Accordingly, it is intended to cover all such modifications, omission, additions and equivalents as may be included within the scope of a wing closer and associated methods as defined by the following claims. In the claims, where a claim is directed to a method, unless otherwise indicated the order of actions to be performed is not limited to the order in which the actions are written. Further, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A closing apparatus for a wing, comprising:

a closer housing adapted to be mounted to a wing or structure adjacent to a wing and having a first end and a second end with a longitudinal axis extending therebetween;

a piston disposed in the closer housing for reciprocal movement along the longitudinal axis;

a compression spring disposed in the closer housing and having a first end abutting the piston and a second end disposed between the compression spring first end and the closer housing second end;

an adjustment screw at least partially disposed in the closer housing along the longitudinal axis and proximate to the closer housing second end;

a collar disposed in the closer housing and defining a threaded opening through which the adjustment screw passes, the threads of the adjustment screw engaging the threads of the opening, the collar adapted to travel along the adjustment screw as the screw is turned, the collar having a first face abutting the second end of the compression spring and having a circular periphery, a second face having a circular periphery, and a side extending between the circular periphery of the first face and the circular periphery of the second face, wherein the side defines a circumferential annular channel;

a magnetic ball that is a permanent magnet disposed in the annular channel, the magnetic ball configured to move freely within the channel; and an indicator housing mounted to the closer housing external to the closer housing, wherein the indicator housing defines an elongated passage; and a magnetically permeable element disposed in the elongated passage of the indicator housing;

wherein the magnetic ball moves the magnetically permeable element for indicating movement of the collar relative to the adjustment screw.

2. The closing apparatus of claim 1, wherein the indicator housing has an arcuate surface on one side that is proximate to the closer housing.

3. The closing apparatus of claim 1, wherein the magnetically permeable element is a magnetic ball that is a permanent magnet.

4. The closing apparatus of claim 1, wherein the indicator housing is at least partially transparent to allow the position of the magnetically permeable element to be viewed through the transparent portion of the housing.

5. The closing apparatus of claim 4, wherein indicia are provided on the indicator housing corresponding to a size of the closing apparatus.

6. The closing apparatus of claim 4, wherein the indicator housing comprises plastic.

7. The closing apparatus of claim 1, wherein the indicator housing has a first end and a second end and further comprises a portion that abuts at least a portion of the second end of the closer housing to locate the indicator housing along the closer housing.

8. A closing apparatus for a wing, comprising:

a closer housing adapted to be mounted to a wing or structure adjacent to a wing and having a first end and a second end with a longitudinal axis extending therebetween;

a piston disposed in the closer housing for reciprocal movement along the longitudinal axis;

a compression spring disposed in the closer housing and having a first end abutting the piston and a second end disposed between the compression spring first end and the closer housing second end;

an adjustment screw at least partially disposed in the closer housing along the longitudinal axis and proximate to the closer housing second end;

a collar disposed in the closer housing and engaging the adjustment screw and the compression spring, the collar defining a circumferential annular channel;

a magnetic ball that is a permanent magnet disposed in the annular channel, the magnetic ball configured to move freely within the channel; and an indicator housing mounted to the closer housing external to the closer housing, wherein the indicator housing defines an elongated passage; and a magnetically permeable element disposed in the elongated passage of the indicator housing;

wherein the magnetic ball moves the magnetically permeable element for indicating movement of the collar relative to the adjustment screw.

9. The closing apparatus of claim 8, wherein the indicator housing has an arcuate surface on one side that is proximate to the closer housing.

10. The closing apparatus of claim 8, wherein the magnetically permeable element is a magnetic ball that is a permanent magnet.

11. The closing apparatus of claim 8, wherein the indicator housing is at least partially transparent to allow the position of the magnetically permeable element to be viewed through the transparent portion of the housing.

12. The closing apparatus of claim 11, wherein indicia are provided on the indicator housing corresponding to a size of the closing apparatus.

13. The closing apparatus of claim 11, wherein the indicator housing comprises plastic.

14. The closing apparatus of claim 8, wherein the indicator housing has a first end and a second end and further comprises a portion that abuts at least a portion of the second end of the closer housing to locate the indicator housing along the closer housing.

* * * * *